US011629925B2

(12) United States Patent
Wingrove et al.

(10) Patent No.: US 11,629,925 B2
(45) Date of Patent: Apr. 18, 2023

(54) FIREARM BOLT HOLD-OPEN ASSEMBLY AND METHODS OF USE THEREOF

(71) Applicant: PDG, Inc., Longmont, CO (US)

(72) Inventors: Paul Wingrove, Longmont, CO (US); Douglas Norat, Loveland, CO (US)

(73) Assignee: PDG, Inc., Longmont, CO (US)

( * ) Notice: Subject to any disclaimer, the term of this patent is extended or adjusted under 35 U.S.C. 154(b) by 0 days.

(21) Appl. No.: 17/678,664

(22) Filed: Feb. 23, 2022

(65) Prior Publication Data

US 2022/0341691 A1 Oct. 27, 2022

Related U.S. Application Data

(60) Provisional application No. 63/152,660, filed on Feb. 23, 2021.

(51) Int. Cl.
*F41A 17/36* (2006.01)
*F41A 17/42* (2006.01)

(52) U.S. Cl.
CPC ..... *F41A 17/36* (2013.01); *F41A 17/42* (2013.01)

(58) Field of Classification Search
CPC ..... F41A 17/34; F41A 17/36; F41A 17/40; F41A 17/42
See application file for complete search history.

(56) References Cited

U.S. PATENT DOCUMENTS

| | | | | |
|---|---|---|---|---|
| 1,818,984 | A * | 8/1931 | Browning | F41A 3/32 89/169 |
| 2,321,045 | A * | 6/1943 | Roemer | F41A 17/36 89/138 |
| 2,389,631 | A * | 11/1945 | Moore | F41A 3/32 89/142 |
| 3,446,114 | A | 5/1969 | Ketterer | |
| 3,688,640 | A | 9/1972 | Seecamp | |
| 3,846,928 | A | 11/1974 | Ruger et al. | |
| 4,057,003 | A | 11/1977 | Atchisson | |
| 4,455,919 | A | 6/1984 | Osborne et al. | |
| 4,697,495 | A | 10/1987 | Beretta | |
| 7,261,029 | B1 | 8/2007 | Davis | |
| 9,482,480 | B2 | 11/2016 | O'Dell | |
| 10,228,201 | B2 * | 3/2019 | Walther | F41A 35/06 |
| 2005/0000138 | A1 * | 1/2005 | Kiss | F41A 17/36 42/50 |
| 2011/0247483 | A1 * | 10/2011 | Overstreet | F41A 9/70 89/138 |
| 2013/0014416 | A1 * | 1/2013 | Sisgold | F41A 9/66 42/17 |
| 2014/0075810 | A1 * | 3/2014 | Mikroulis | F41A 17/36 42/50 |
| 2022/0196361 | A1 * | 6/2022 | Nedev | F41A 3/42 |

* cited by examiner

*Primary Examiner* — Gabriel J. Klein
(74) *Attorney, Agent, or Firm* — Berg Hill Greenleaf Ruscitti LLP

(57) ABSTRACT

The inventive technology is directed to a bolt hold-open system configured to lock the bolt of an AK-47 firearm, or variants of the AK-47, in an open position after the last cartridge in a magazine has been ejected.

18 Claims, 11 Drawing Sheets

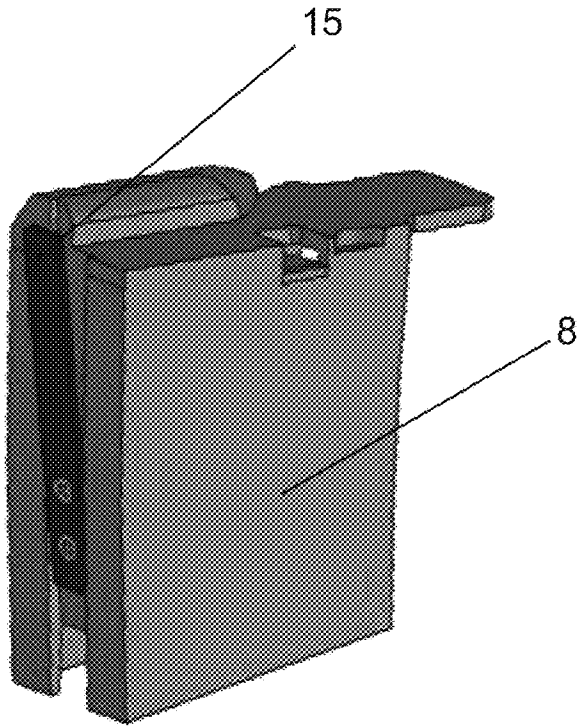
C
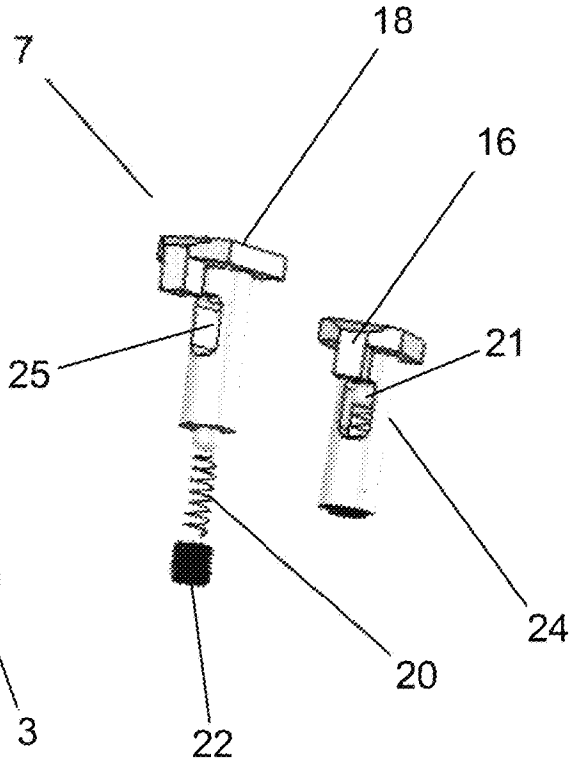
B
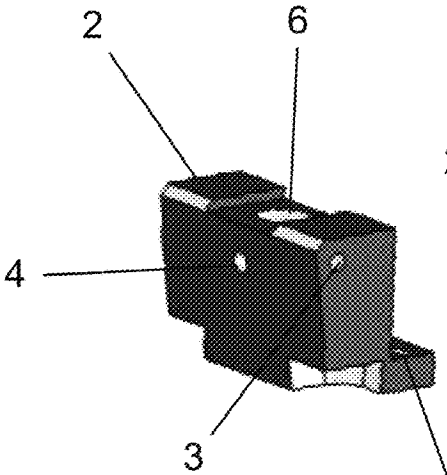
A
FIGS. 4A-C

FIREARM BOLT HOLD-OPEN ASSEMBLY AND METHODS OF USE THEREOF

CROSS REFERENCE TO RELATED APPLICATIONS

This application claims the benefit of and priority to U.S. Provisional Application No. 63/152,660, filed Feb. 23, 2021. The entire specification and figures of the above-referenced application are hereby incorporated, in their entirety by reference.

TECHNICAL FIELD

The inventive technology is directed to the field of firearms, and particularly to a system for locking the bolt of a firearm in an open position. In one particular embodiment, the inventive technology is directed to a bolt hold-open system configured to lock the bolt of an AK-47 firearm, or variants of the AK-47, in an open position after the last cartridge in a magazine has been ejected.

BACKGROUND

The Kalashnikov rifle (AK-47) and its variants represent one of the most successful and widely adopted rifle designs in the world. Despite its widespread adoption for both military and personal use throughout the world, the design and functionality of a typical AK-47 rifle is limited in certain aspects. For example, the standard AK-47's design lacks an automatic bolt hold-open system. A bolt hold-open system allows for the rifle's bolt to be maintained in an "open position" after the last cartridge or round has been fired. For example, in a typical firing sequence, when the last cartridge in the magazine is discharged, the bolt returns to the closed position without picking up a new cartridge. After replacing the empty magazine with a full magazine, it is necessary to manually pull back the bolt, typically with a charging handle, to chamber the first cartridge of the new magazine.

While this firing and reloading sequence can be done quickly, especially by an experienced marksman, the lack of a bolt hold-open system prevents a user from knowing when the last round has been discharged resulting in unwanted dry-firing or entering into a live-fire engagement without knowing that the magazine is spent, or when it has fully exhausted. Such critical distinctions can be a matter of life or death in many situations.

In other situations, such as traveling with the rifle, or visiting a shooting range, it may be advantageous, or even required by range authorities that the bolt to be held in the "open" position for safety and to ensure a round has not been chambered and ready to fire unexpectedly. A bolt hold-open device, such as the assembly described herein addresses these concerns. Several attempts have been made to provide a functional and economical a bolt hold-open device in the past; however, each has fallen short in one way or another.

For example, U.S. Pat. No. 9,482,480 provides a bolt hold-open for an AK-47, but the system described a bolt hold-open system having a modified magazine and a locking assembly positioned above the trigger. However, this system is limited by its inability to be retrofit using existing rivets and other standard factory holes present in a pre-fabricated AK-47 receiver, in instead requires the drilling of additional holes in the receiver to accommodate the hold-open device. This renders the firearm altered permanently, preventing it from being reverted to original condition if so desired or required. Moreover, the cross-bracing pin present with stamped receiver designs common to AK-47 produced in much of the world would block the installation of the '480 Patent's magazine catch.

U.S. Pat. No. 7,261,029 also provides a bolt hold-open for an AK-47, but the system disclosed by this patent requires the modification of the bolt carrier, the receiver carrier, and the magazine. A system that limits modifications to the gun is preferable, since it allows the use of a wider variety of replacement parts. Furthermore, the bolt hold-open release mechanism of the system provided cannot be activated by the trigger hand since the mechanism is high on the gun, and this bolt hold-open can only be released on one side of the gun.

Additional bolt hold-open systems have also been described in the prior art, including, but not limited to:

U.S. Pat. No. 3,446,114 which teaches a trigger mechanism for automatic firearms employing a hammer firing device, having a means for converting both from semi-automatic to full-automatic firing and, simultaneously, from closed bolt to open bolt operation, including a catch lever, which, when the firearm is in an automatic firing mode, projects into the passive movement of the breech block, catching and holding the breech block in its rearward position, and further including a driving member for displacing the catch lever from its normal position.

U.S. Pat. No. 3,688,640 which teaches a bolt-open latch for a repeating firearm where the bolt-open latch becomes operable by movement of a cartridge carrier beyond its cartridge-feeding position, in order to latch the breech-bolt in an open position when no cartridge is available to be fed into the chamber.

U.S. Pat. No. 3,846,928 which teaches a bolt lock means comprised of a longitudinally disposed bolt lock lever pivotally mounted on the side of the cartridge receiver and having a magazine follower engaging arm at the forward end thereof and a bolt stop arm at the rearward end thereof.

U.S. Pat. No. 4,057,003 which teaches an open-bolt firing conversion for the standard M16 rifle, which allows the rifle to be converted to open-bolt firing by replacement of parts.

U.S. Pat. No. 4,455,919 which teaches an action disabling device in a firearm in the form of an operating arm pivotable in and out of the closing path of the breech bolt to stop the breech bolt on partial closure of the same, whereby the operating arm pivots when engaged by the cartridge lifter during overtravel of the lifter in lift direction for lack of a cartridge thereon.

U.S. Pat. No. 4,697,495 which teaches a tripping mechanism for the conversion of automatic rifles of the closed-bolt to the open-bolt type, to allow the selection of either single firing or automatic fire. The components are pre-mounted within a box-like support which is readily insertable in the trip box of a conventional automatic rifle.

As can be seen from the foregoing, there exists a need for an improved bolt hold-open system that is both effective, economical, and can be quickly adapted to existing firearms, such as the AK-47 and its variants.

SUMMARY OF THE INVENTION

In a traditional firearm, the force generated by the discharge of a chambered cartridge propels the round out the barrel of the gun, while also generating an opposite force pushing the bolt assembly backward far enough to eject the spent casing. A return spring exerts an opposing force initiating the forward return motion of the bolt assembly, causing it to return to the closed position while chambering the next cartridge from a spring-loaded magazine. After the final cartridge in the magazine is discharged, the bolt assembly returns to the closed position and a new magazine is inserted, at which point the bolt assembly must be manually engaged to chamber the first new cartridge. To maintain the bolt in an open position, a bolt hold-open apparatus is required to be incorporated into the firearm.

One aspect of the invention includes systems, methods and apparatus for an improved bolt hold-open system, and in particular a bolt hold-open system that may be adapted to an AK-47, or similar rifle. The bolt hold-open system of the invention may include a block having included a plurality of match rivet points that correspond to pre-existing rivet points on the receiver of a traditional AK-47 or variants thereof. This block may be mounted within the receiver of an AK-47 type rifle and may be secured by replacing the pre-existing rivets with a fastener, such as a screw compatible with firearm construction.

The bolt hold-open system of the invention may include a lifter assembly that may be mounted in the block and engaged by a magazine follower configured to exert an upward force on a break type tab of the lifter assembly. This upward force extends the lifter assembly against the bottom surface of the firearm's bolt when the last round of a magazine is chambered. When this last cartridge is discharged the bolt, assembly moves rearward in response to an ejection force generated by the discharged round. Once the bolt has cleared the top surface of the lifter assembly, the lifter is extended into the forward return path of the bolt, blocking its forward motion, thereby holding it in an open position.

As part of the firing cycle, the empty magazine may be replaced. Withdrawal of the magazine disengages the magazine follower and lifter assembly, removing the upward force. However, the return spring force holds the lifter assembly in place until released by manually disengaging the bolt and lifter assembly, typically by engaging a charging handle to break the connection between the two components, causing the spring loaded lifter to move back down, or alternatively through a release assembly configured to manually retract the lifter assembly downward to a position below the forward return path of the bolt.

Additional aspects of the various embodiments of the systems, methods, and apparatus for the bolt hold-open assembly of the invention will become readily apparent and better understood in view of the description and accompanying drawings.

BRIEF DESCRIPTION OF THE FIGURES

FIGS. 4A-C shows (A) a block having a plurality of match rivet attachment points, (B) an expanded and configured lifer assembly, and (C) a follower having a flat spring configured to engage the lifter assembly in one embodiment thereof.

DETAILED DESCRIPTION OF THE INVENTION

Figure 1:
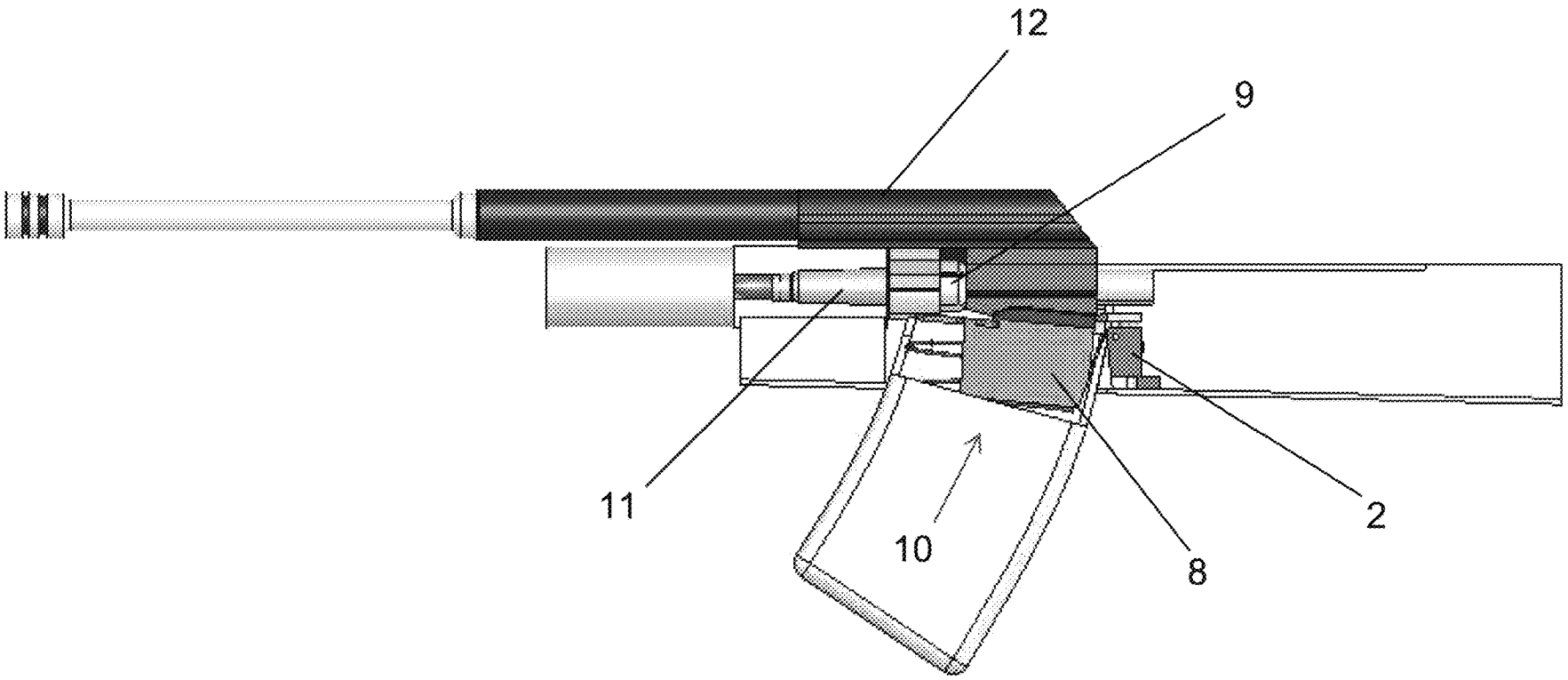
FIG. 1 shows a side-view of a bolt hold-open assembly positioned within an AK-47 type firearm, with the bolt in a closed position and illustrating the last cartridge having been chambered from the magazine in one embodiment thereof.
Figure 2:
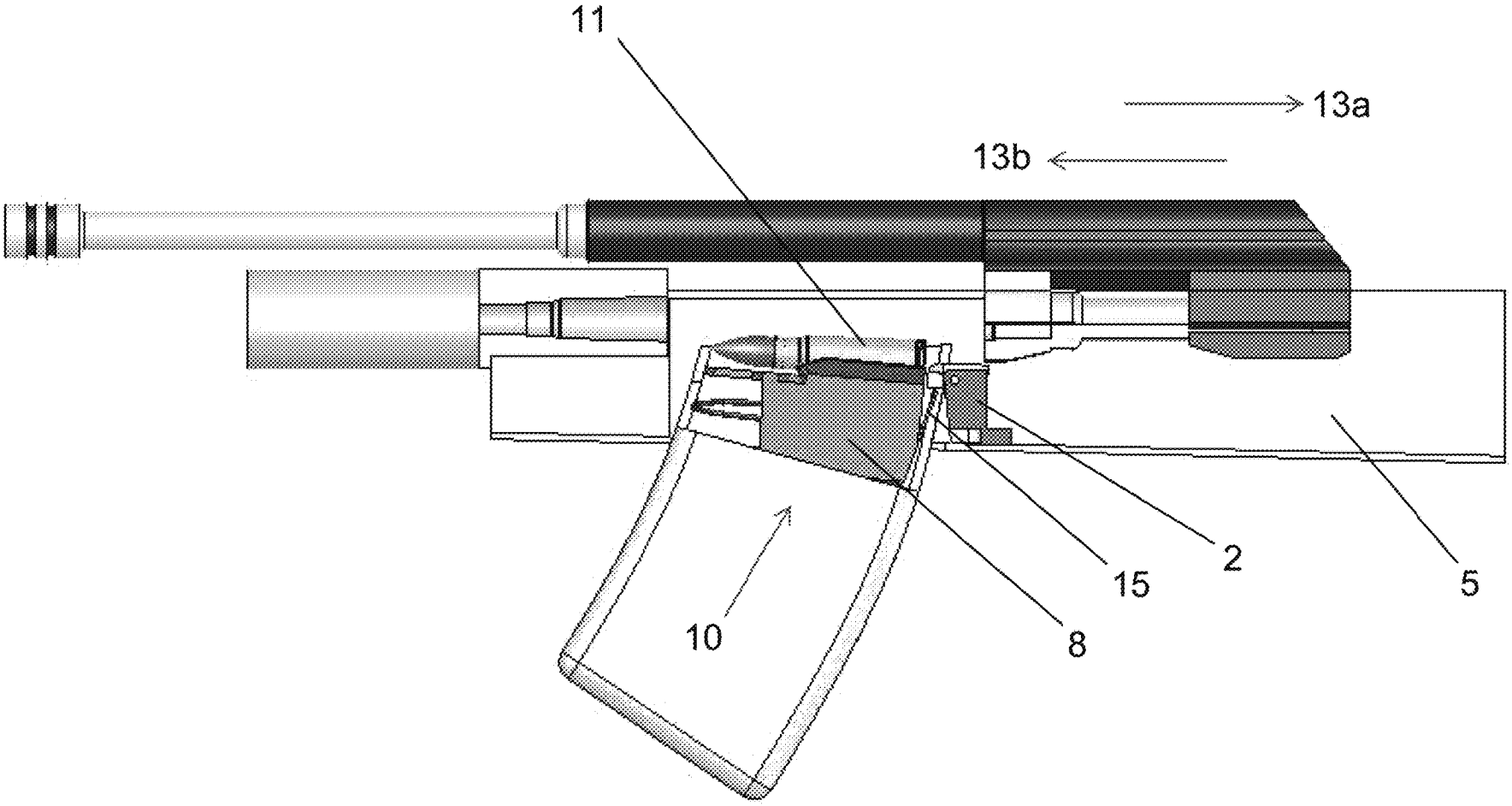
FIG. 2 shows an expanded side-view of a bolt hold-open assembly positioned within an AK-47 type firearm, with a magazine follower engaging a lifter assembly, showing the bolt in an open position and prepared to chamber a final cartridge from the magazine in one embodiment thereof.
Figure 3:
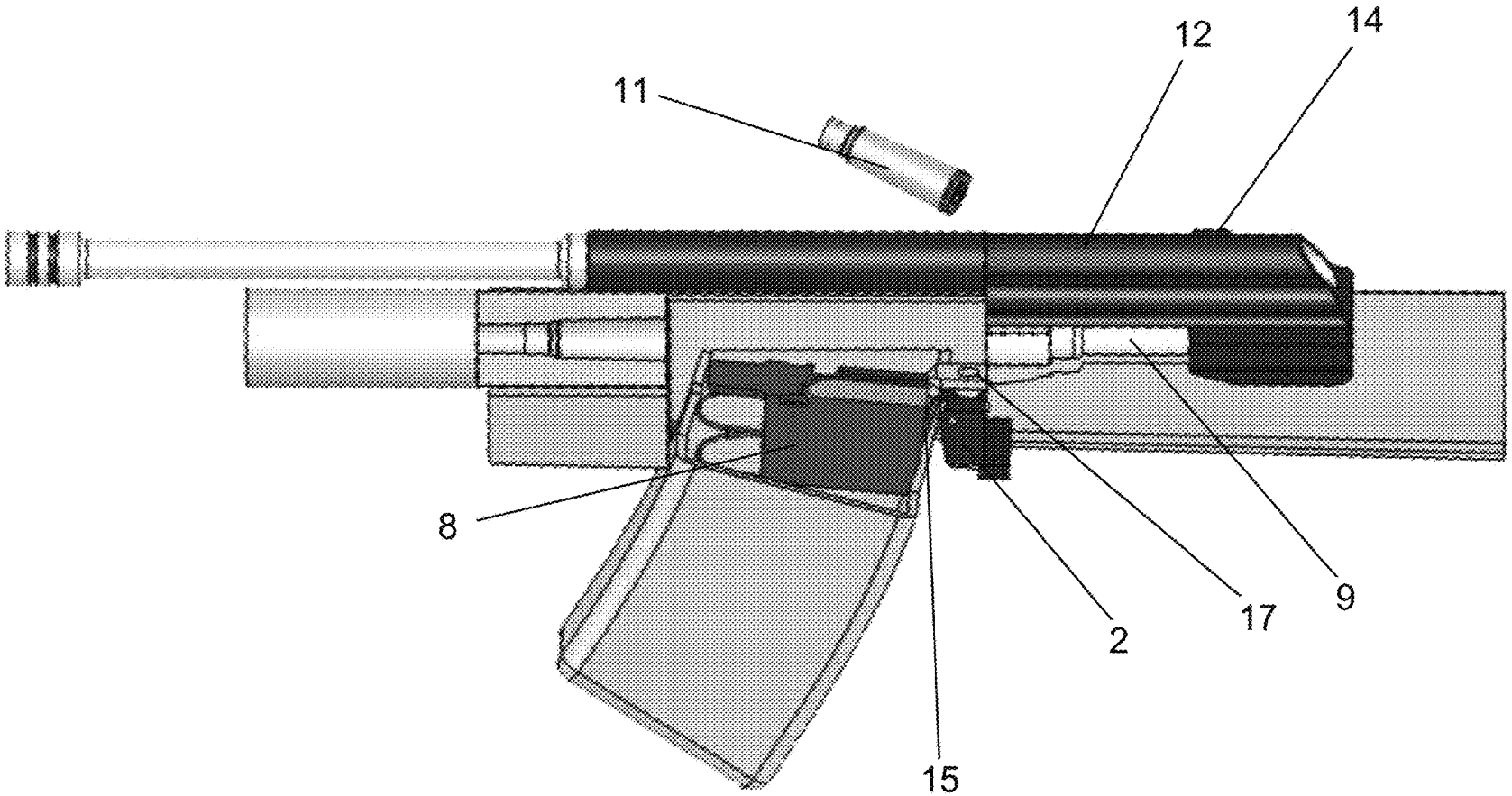
FIG. 3 shows a perspective-view of a bolt hold-open assembly positioned within an AK-47 type firearm, with a magazine follower engaging a lifter assembly which engages and blocks/holds the bolt in an open position after ejection of the final casing from the magazine in one embodiment thereof.

The bolt hold-open system of the invention may include a lifter assembly (7), that may be positioned below the bolt assembly (9, 12) of a firearm and secured to a mounted block (2) within the firearm's receiver (5). In this preferred embodiment, a magazine follower (8), positioned within a spring-loaded magazine, travels upward as cartridges are discharged and ejected as part of the firing cycle. As the last cartridge is chambered, the magazine follower (8) engages the lifter assembly (7) and exerts an upward force pressing it against the underside of the firearm's bolt (9).

In another embodiment, the bolt hold-open system (1) of the invention may include systems, methods and apparatus to quickly and manually engage and/or release the bolt hold-open system. In this preferred embodiment, the discharge of the last cartridge of a magazine generates an ejection force causing the bolt assembly (9, 12) to move rearward past the lifter assembly (7), allowing it to extend, or be pushed upward and block the forward return motion of said bolt assembly (9, 12). The now empty magazine may be removed, while the lifter assembly (7) is held in place by the return spring force of the bolt assembly (9, 12).

In another embodiment, a user may disengage the bolt assembly (9, 12) from the lifter assembly (7), for example by engaging a charging handle (14) to pull the bolt assembly (9, 12) rearward causing the spring-loaded lifter assembly (7) to retract below the path of the bolt (9) allowing it to traverse along its return forward path. In yet another embodiment, a user may manually disengage the bolt assembly (9, 12) from the lifter assembly (7) through a manual lifter release/engagement assembly (28). In this preferred embodiment, a lifter assembly (7) may be coupled to an adjustable handle assembly (27) by a pull rod (26). In this configuration, a user may use their non-trigger hand to engage and depress the handle assembly (27) and coupled pull rod (26) causing the manual disengagement of the lifter assembly (7) from the bolt assembly (9, 12) and positioning it below the return path of the bolt.

As noted above, in some circumstances a user may wish to manually engage the lifter assembly (7) allowing it to extend or be pushed upward and block the forward return motion of the bolt assembly (9, 12) when a magazine is not inserted into the receiver. In this preferred embodiment, a user can remove the magazine from the receiver (5) thereby eliminating the upward force of the magazine follower (8) on the lifter assembly (7). Next a user may engage a charging handle (14) to pull the bolt assembly (9, 12) rearward. With no return spring force (13*b*), the top plate (18) of the lifter assembly (7) retracts below the forward return path of the bolt assembly (9, 12). In this configuration, the user may manually apply an upward force to the adjustable handle assembly (27) coupled to a pull rod (26) on the release/engagement assembly (28). This action causes the upward movement of the lifter assembly (7). With the bolt assembly (9, 12) in the rearward position the lifter assembly (7) is extended blocking its forward return path when the user disengages the charging handle. As a result, the bolt (9) may be manually positioned in an open position all while there is no magazine in the receiver.

Individual components of the bolt hold-open assembly (1) of the invention, and their methods of use are detailed below:

Block

The bolt hold-open assembly (1) of the invention may include a block (2) configured to be internally positioned within the firearm and support a lifter assembly (7) as detailed below. In a preferred embodiment the block (2) of the invention may be formed from a single hardened steel component. In the preferred embodiment shown in FIGS. 4-5, the block (2) includes a plurality of matched attachment rivet points (3) that correspond to pre-existing rivets or rivet holes in standard AK-47 type designs. In this configuration, the block (2) may be positioned below the bolt assembly (9, 12) and adjacent to the chamber of an AK-47 type rifle, and further secured by one or more fasteners, such as a screw, bolt or other fastener appropriate for firearm construction, that can be inserted through the pre-existing rivet holes present in the receiver (5). As a result, traditional AK-47 type firearms can be quickly retrofit using pre-existing rivet holes to secure the block (2) within the receiver (5) while eliminating the need to drill additional holes through the receiver (5).

Lifter Assembly

Figure 5:
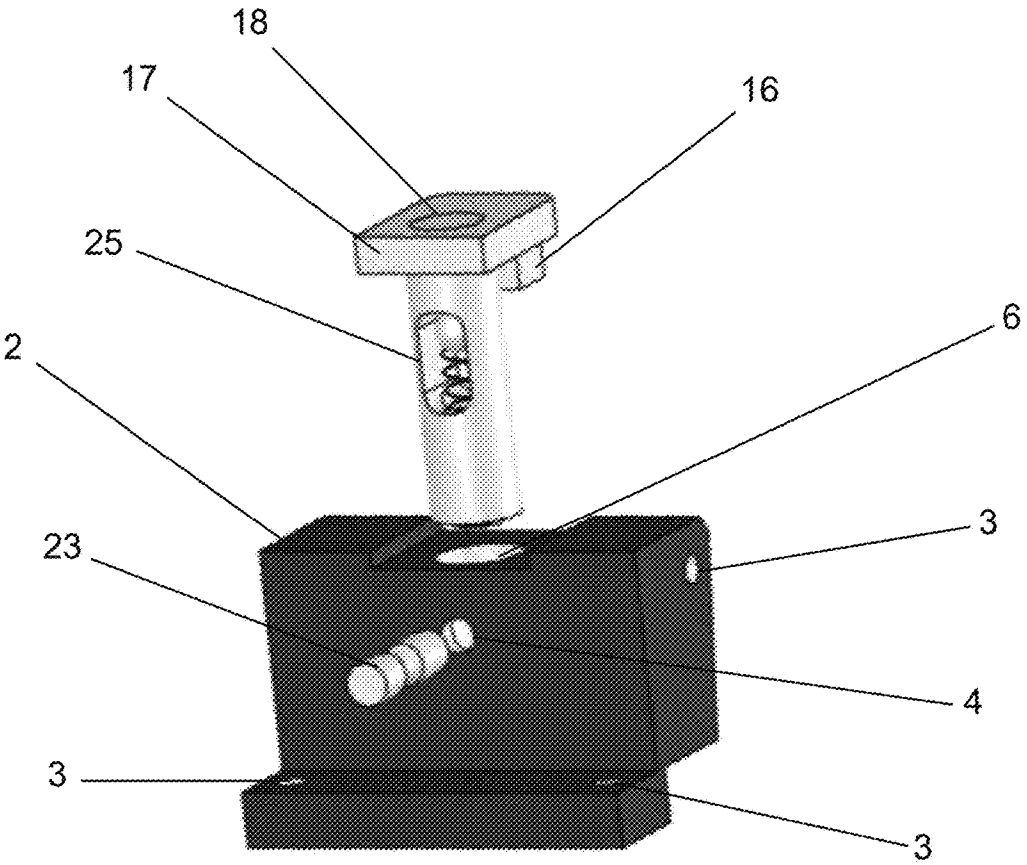
FIG. 5 shows an expanded view of a completed block assembly block configured to internally secure a lifter assembly, which is further secured with an internally positioned cross pin in one embodiment thereof.

The bolt hold-open assembly (1) of the invention may include a lifter assembly (7) that, as shown in FIG. 5, can be positioned within the block (2) and further positioned below the bolt assembly (9, 12). In this preferred embodiment, the block (2) may include a vertical slotted aperture (6) that is configured to hold a lifter assembly (7) of the invention and position the top surface of the lifter assembly (7) below the path of the bolt assembly (9, 12).

Figure 6:
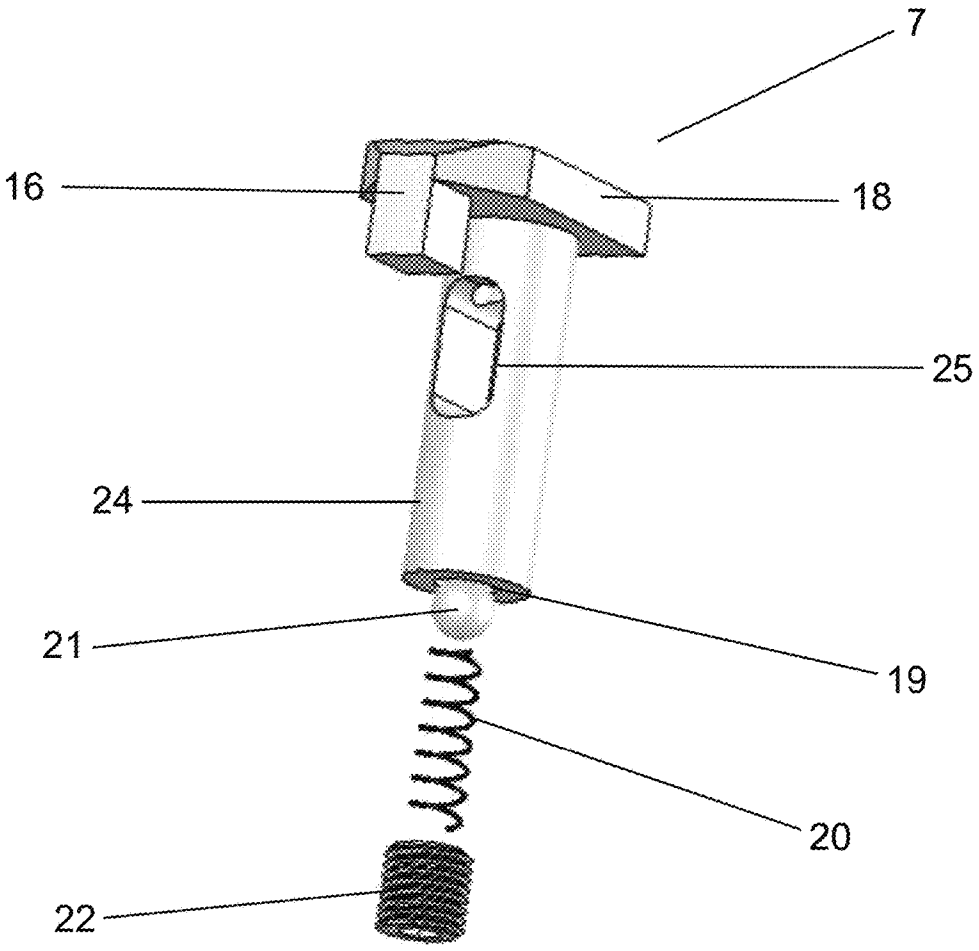
FIG. 6 shows an expanded view of a lifter assembly in one embodiment thereof.
Figure 7:
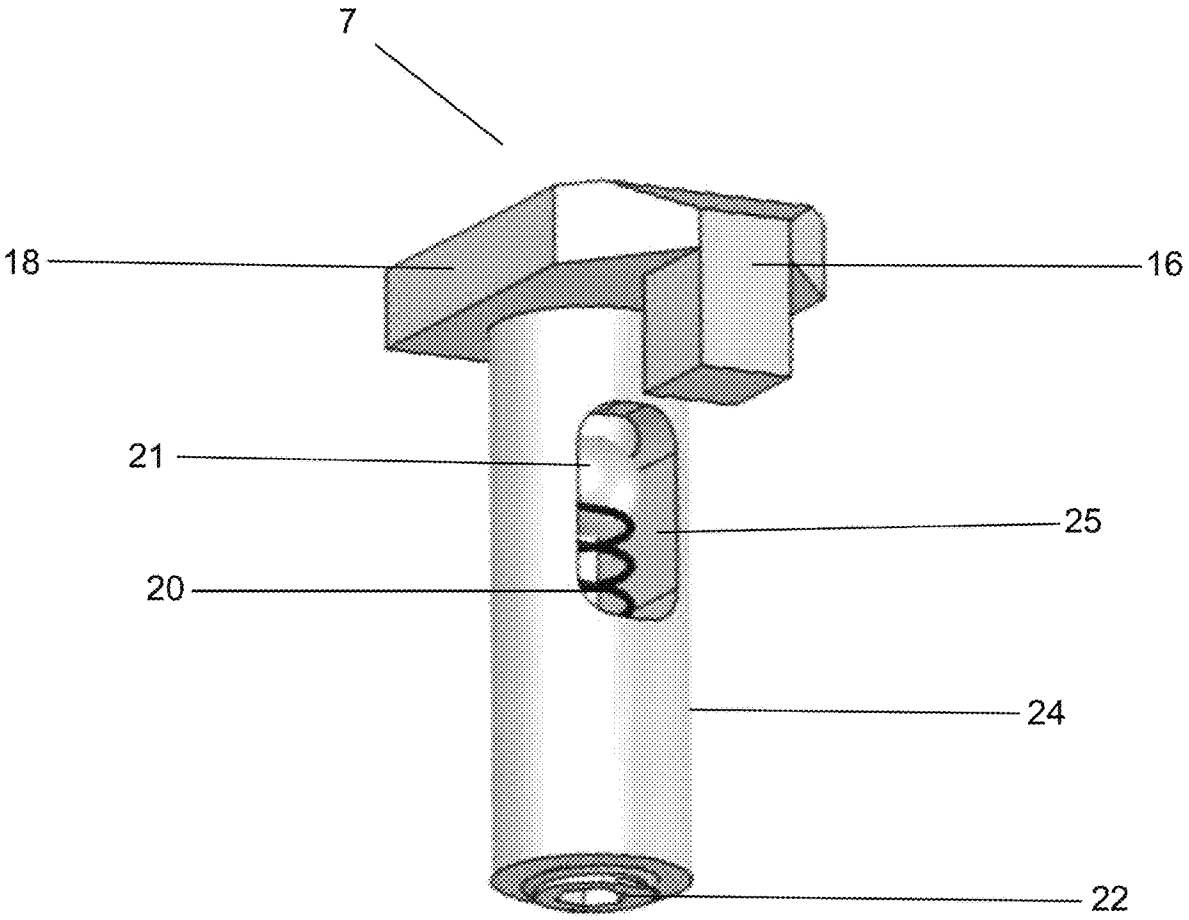
FIG. 7 shows a front view of a lifter assembly having a break tab and an internally secured spring and ball bearing with a cross pin slot in one embodiment thereof.
Figure 8:
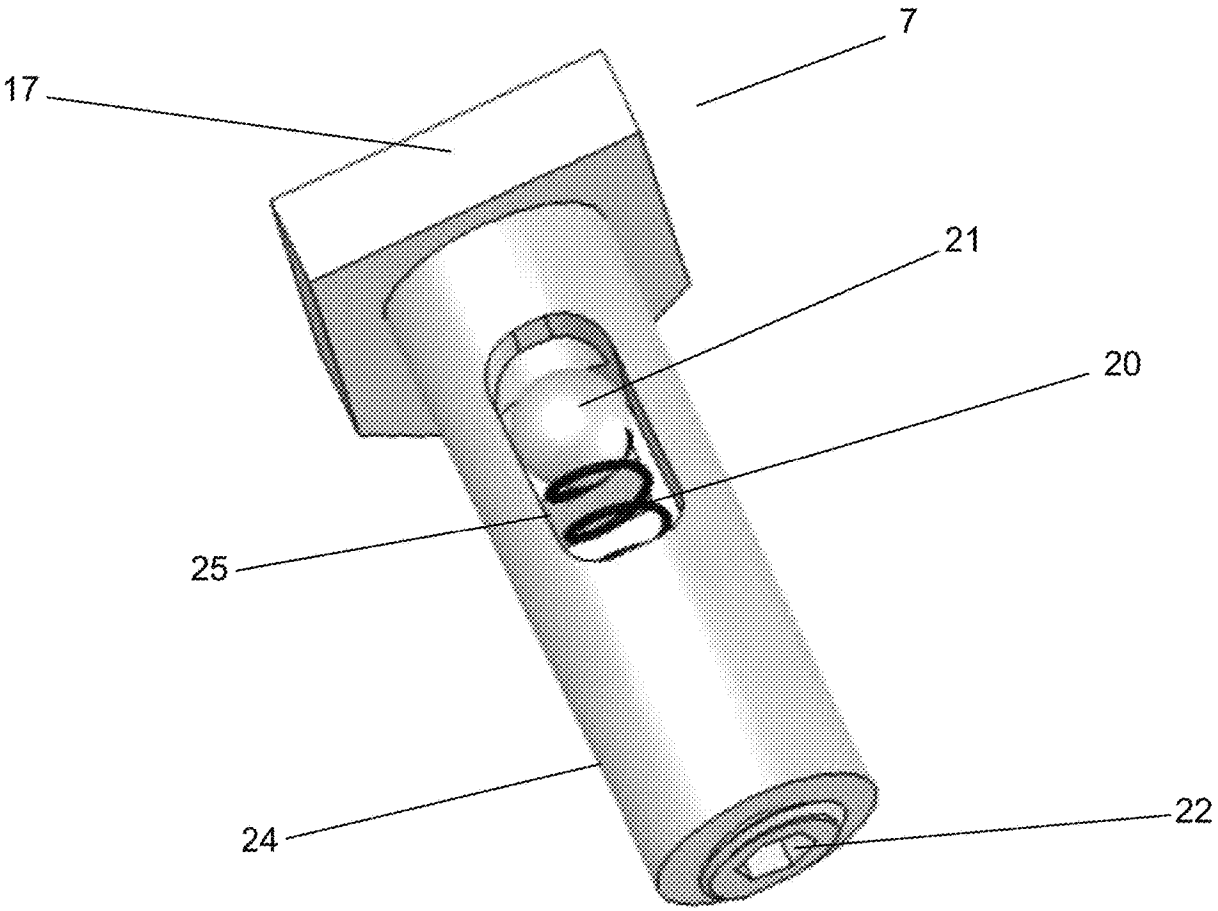
FIG. 8 shows a rear view of a lifter assembly having a bolt stop and an internally secured spring and bearing with a vertical cross pin slot positioned along the length of the lifter assembly shaft in one embodiment thereof.
Figure 9:
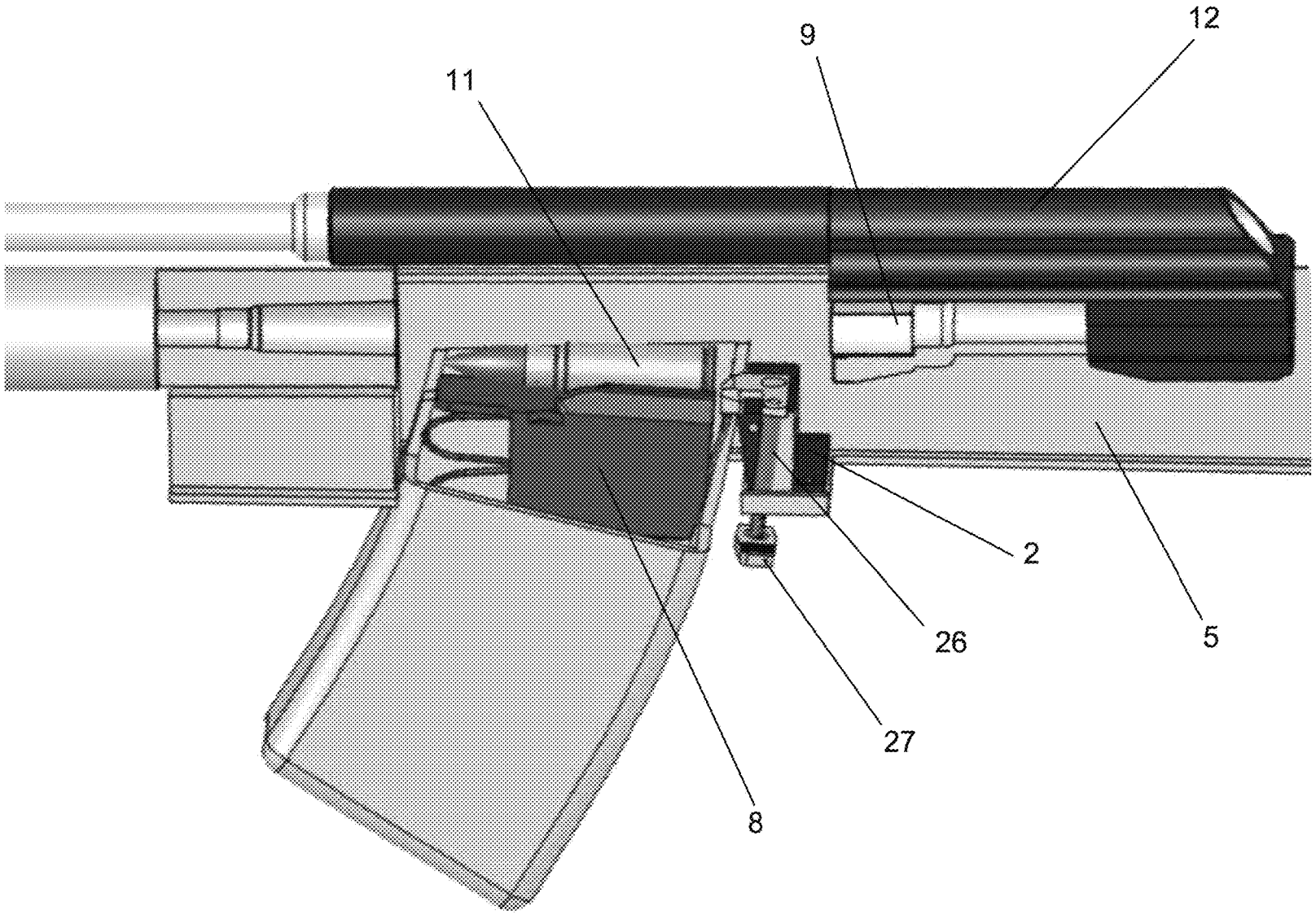
FIG. 9 shows a perspective-view of a bolt hold-open assembly positioned within an AK-47 type firearm, with a magazine follower configured to engage a lifter assembly secured within a block which engages and holds the bolt in an open position after ejection of the final casing from the magazine, as well as a pull rod and handle assembly configured to compress and release or press and extend the lifter assembly in one embodiment thereof.

Referring now to FIG. 4(B), in this embodiment the lifter assembly (7) of the invention may include a spring-loaded apparatus that can be projected upward into the path of the bolt (9) during its forward return motion holding the bolt assembly (9, 12) in the "open" position. As shown in FIGS. 6-8, the lifter assembly (7) of the invention may include a top plate (18) coupled with an elongated shaft (24) that fits inside the slotted aperture (6) of the block (2) and may be configured to move up and down within the aperture as detailed below. A spring (20) may be positioned within a spring housing (19) and positioned along the length of the lifter assembly shaft (24). A bearing, (21) such as a ball bearing may further be positioned adjacent to the spring (20). A coupler (22), such as a plug or stopper, may be attached to the terminal end of the lifter assembly shaft (24) enclosing the spring (2) and bearing (21) within the spring housing (19).

The lifter assembly (7) of the invention may include a cross pin slot (25) positioned along the length of the shaft (24) and positioned below the top plate (18). As shown, the cross pin slot (25) may include an elongated space traversing a portion of the length of the shaft (24) of the lifting assembly (7). In the preferred embodiment shown in FIG. 5, the lifter assembly (7) may be positioned within the slotted aperture (6) such that the cross pin slot (25) may be aligned with pin aperture (4) of the block (2). Next, the cross pin (23) is inserted through the pin and cross pin slots (4, 25) respectively, securing the lifter assembly (7) to the block. As noted in FIG. 5, the cross-pin (23) can be positioned above the bearing (21) and spring (20) and may include a depression or groove to accommodate the round bearing. In this configuration, the lifter assembly (7) is combined with the block (2) to form a stationary pressure sensitive apparatus that can be positioned below a firearm's bolt assembly (9, 12) and extended in response to an upward force, thereby blocking the forward return path of the bolt (9), or be retracted downward, in response to the return spring force from the internally positioned spring (20). In this manner, the length of the cross pin slot (25) defines the vertical traverse length of the lifter assembly (7).

Figure 10:
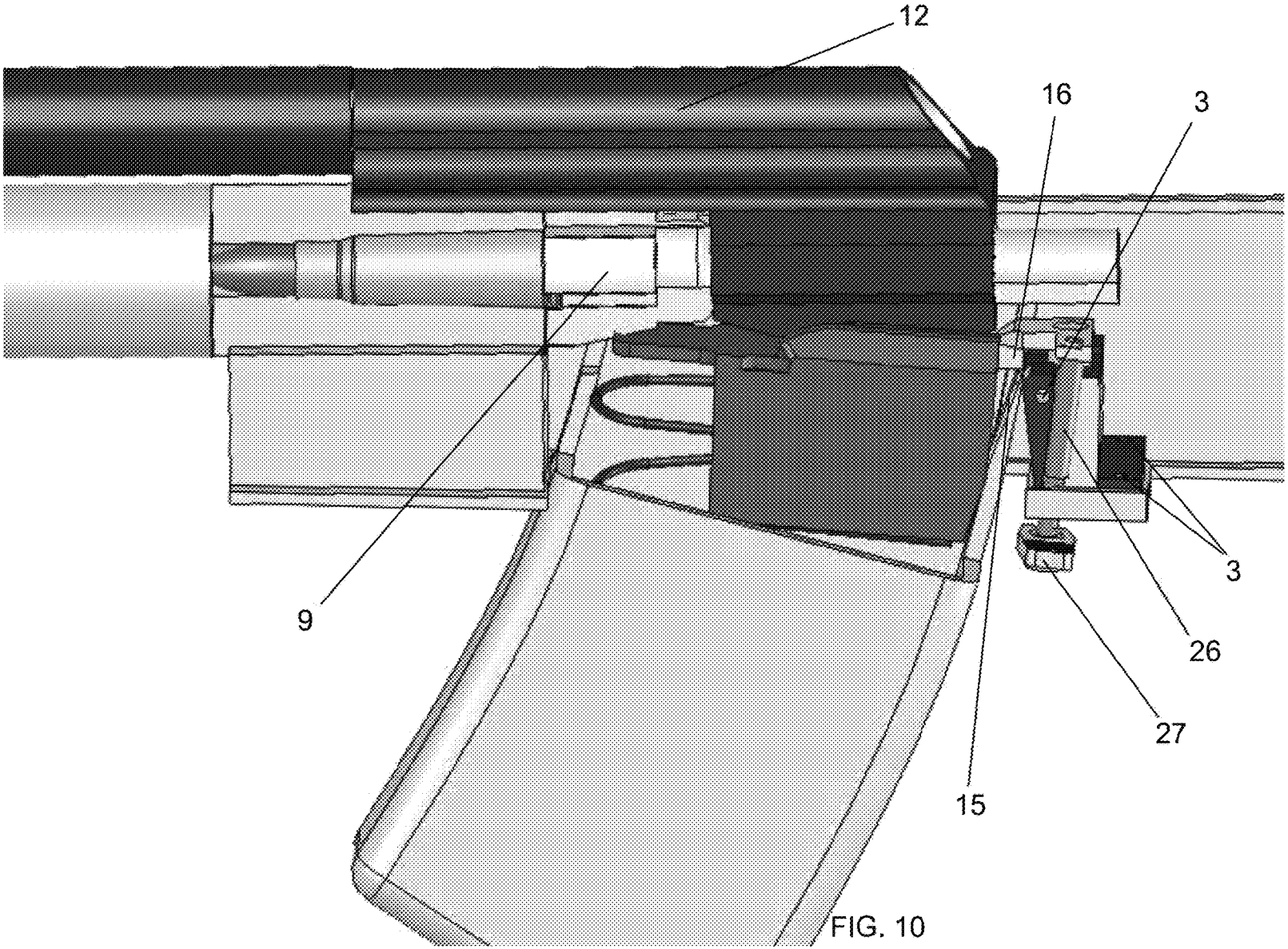
FIG. 10 shows a side-view of a bolt hold-open assembly positioned within an AK-47 type firearm, with a magazine follower configured to engage a lifter assembly secured within a block as well as a pull rod and handle assembly configured to compress and release or be raised and engage the lifter assembly in one embodiment thereof.
Figure 11:
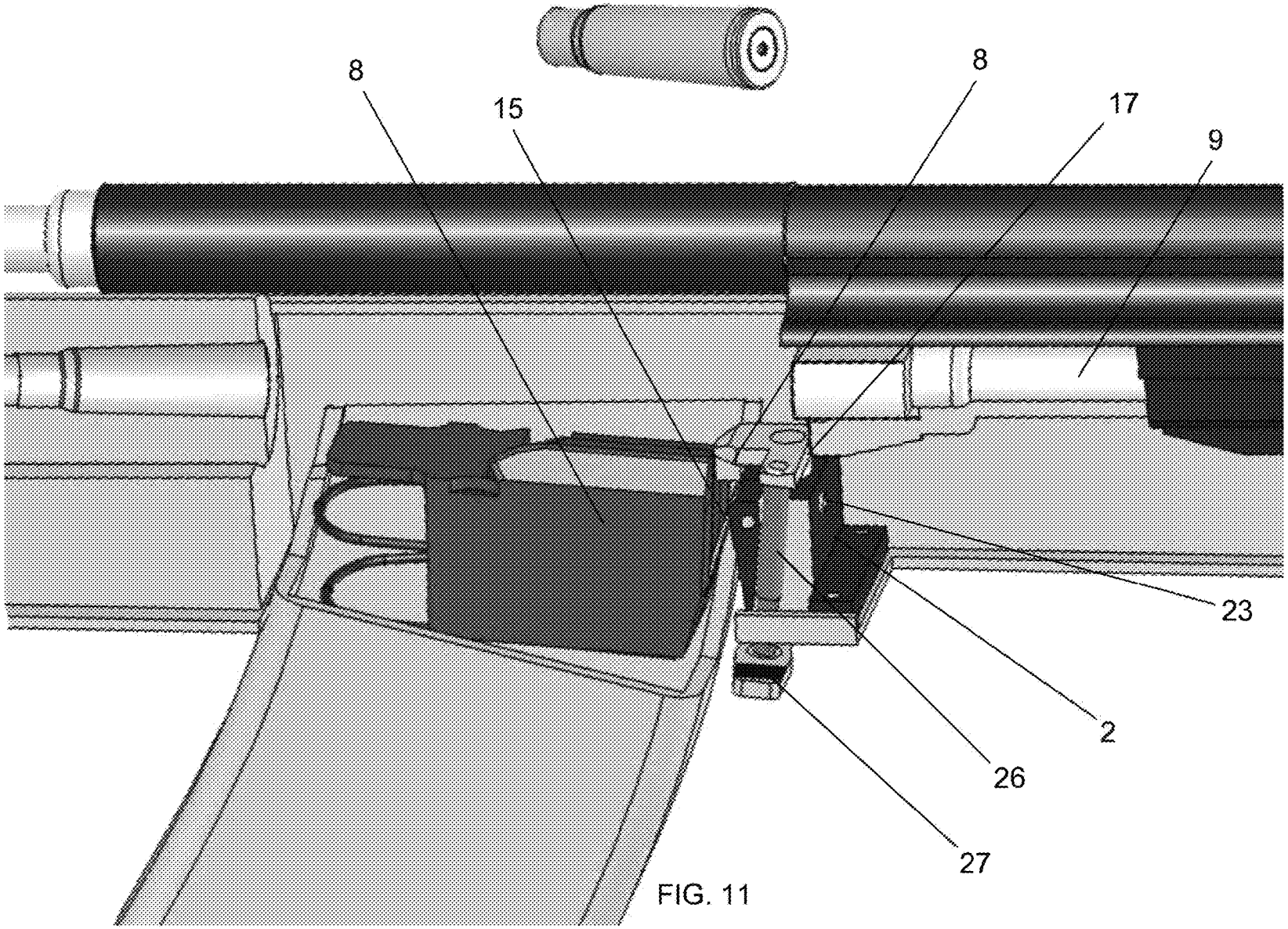
FIG. 11 shows a perspective-view of a bolt hold-open assembly positioned within an AK-47 type firearm, with a magazine follower engaging a lifter assembly secured within a block which engages and holds the bolt in an open position after ejection of the final casing from the magazine, as well as a pull rod and handle assembly configured to compress and release, or to be raised and engage the lifter assembly in one embodiment thereof.

The lifter assembly (7) of the invention may include a top plate (18) configured to be positioned below the bolt assembly (9, 12) in its retracted position, such top plate (18) having a break tab (16) and a bolt stop (17) surface. As shown in FIGS. 6 and 10, the break tab (16) may include a projection that extends from the front of the top plate (18) past the front surface of the block (2). The break tab (16) may further include a fitted cleft positioned over the top surface of the block (2) such that when in the retracted position, the bottom surface of the top plate (18) is approximately flush with the top surface of the block (2) while the break tab (16) extends below the top surface of the block (2), providing an engagement surface to initiate its upward movement as detailed below.

Magazine Follower and Manual Release

The bolt hold-open assembly (1) of the invention may include a magazine follower (8) configured to engage the break tab (16) after the last cartridge of a magazine has been chambered. The magazine follower (8) may include a unitary, or multi-component device that is configured to be positioned within a firearm magazine, and preferably a magazine compatible with an AK-47, or variant thereof. Cartridges may be loaded into the magazine causing the magazine follower (8) to be compressed downward. In a preferred embodiment, the rear surface of the magazine follower (8) may include a flat spring (15) that may be compressed inward towards the body of the follower and away from the rear inside face of the magazine (8) allowing it to slide down into the magazine during the cartridge loading procedure. In one embodiment the flat spring (15) may be a separable component, while in alternative embodiments it may be an integral component with the magazine follower (8). For example, in a preferred embodiment, a magazine follower (8) having a flat spring (15) may be formed as a single thermo-molded component.

As shown in FIGS. 1-4, as cartridges are discharged and new ones re-chambered the magazine follower (8), in response to the force of a magazine spring (10), is pushed upward towards the chamber. As the last cartridge is chambered, the flat spring (15) of the magazine follower (8) engages the break tab (16), exerting an upward force on the top plate (18) and positioning it against the bottom of said bolt (9). As the final cartridge is discharged, the bolt assembly (9, 12), in response to an ejection force (13*a*) generated by the discharged cartridge, moves rearward over the top plate (8). Once the bolt (9) has cleared the surface of the top plate (18) on its rearward traverse, the upward force exerted on the break tab (18) by the flat spring (15) causes the top plate (18) to extend upward into the pathway of the returning bolt (9). The return spring force (13*b*) moves the bolt (9) into contact with the bolt stop (17) surface of the extended lifter assembly (7), thereby blocking the forward return motion of said bolt assembly (9, 12).

As part of the firing cycle a user removes the magazine from the receiver disengaging the flat spring (15) of the magazine follower (8) and the break tab (16) of the lifter assembly (7). Despite losing the upward force from the magazine follower (8), the return spring force (13*b*) holds the lifter assembly (7) in the extended position maintaining the bolt (9) in the open position. The user may return the bolt (9) to the closed position by engaging a charging handle (14) and pulling against the return spring force (13*b*), breaking the contact between the bolt (9) and the bolt stop (17). Once disengaged, the spring (20) positioned within the spring housing (19) exerts a return force on the lifter assembly, retracting it to its original position below the bolt assembly (9, 12). Its forward return path now clear, the bolt assembly (9, 12) returns to the closed position. This disengagement sequence can be executed with or without a new magazine being inserted into the chamber, thereby allowing the bolt (9) to return to the closed position with or without a new cartridge being chambered.

Handle Release

In an alternative embodiment, the invention may include a lifter release/engagement assembly (28) configured to allow a user to manually retract the lifter assembly (7), allowing the bolt (9) to return to the closed position. As shown in FIGS. 9-12, the top plate (18) or a lifter assembly may be coupled with a handle assembly (27) through a pull rod (16). The pull rod (16) may extend through a secondary factory hole in the bottom of a receiver (5) to a position where a user can easily engage and compress the handle assembly (27). Notably, in this embodiment, the pull rod (16) and handle assembly extend through the receiver (5) on the left side of the of the firearm, allowing the user to engage the handle assembly (27), for example, with their non-trigger hand. Engagement of the handle assembly (27) exerts a downward force on the extended lifter assembly (7), causing it to disengage from the bolt (9). Having been removed from the forward return pathway, the return spring force (13*b*) causes the bolt assembly (9, 12) to compete its forward return movement to the closed position. This alternative disengagement sequence can be executed with or without a new magazine being inserted into the chamber, thereby allowing the bolt to be manually returned to the closed position with or without a new cartridge being chambered.

In an alternative embodiment, the invention may include a lifter release/engagement assembly (28) configured to allow a user to manually extend the lifter assembly (7), preferably when no magazine is present in the receiver, allowing the bolt (9) to be maintained in the open position. As shown in FIGS. 9-12, a user may engage a charging handle (14) and pull the bolt assembly (9,12) rearward. Next, with the magazine removed from the receiver (5), the user may apply an upward force on the lifter release/engagement assembly (28) by pressing on the handle assembly (27). This upward force is communicated to the lifter assembly (7) through the pull rod (16) (in this instance acting as a push rod) causing the top plate (18) of the lifter assembly (7) to be extended into the forward return path of the bolt (9). Next, the user may disengage the charging handle (14) causing the return spring force (13*b*) to move the bolt assembly (9, 12) forward and engage the manually extended top plate (18) of the lifter assembly (7). The user may then remove the upward force on the handle assembly (27) causing the bolt assembly (9, 12) to be placed and maintained in the open position when no magazine is present in the receiver (5).

Naturally, all embodiments discussed herein are merely illustrative and should not be construed to limit the scope of the inventive technology consistent with the broader inventive principles disclosed. As may be easily understood from the foregoing, the basic concepts of the present inventive technology may be embodied in a variety of ways. It generally involves apparatus, systems, methods, and techniques as well as devices to accomplish an improved bolt hold-open assembly, and in particular a bolt hold-open system that can be rapidly and inexpensively retrofit to traditional AK-47 type designs. In this application, the improved techniques, including novel and unique methods and apparatus for an improved bolt hold-open assembly and the like are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the inventive technology and may not explicitly show how each feature or element can actually be representative of a broader function or of a great variety of alternative or equivalent elements. Again, these are implicitly included in this disclosure. Where the inventive technology is described in device-oriented terminology, each element of the device implicitly performs a function. Apparatus claims may not only be included for the device described, but also method or process claims may be included to address the functions the inventive technology and each element performs. Neither the description nor the terminology is intended to limit the scope of the claims that will be included in any subsequent patent application.

It should also be understood that a variety of changes may be made without departing from the essence of the inventive technology. Such changes are also implicitly included in the description. They still fall within the scope of this inventive technology. A broad disclosure encompassing the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "coupler" should be understood to encompass disclosure of the act of "coupling"—whether explicitly discussed or not—and, conversely, were there effectively disclosure of the act of "coupling", such a disclosure should be understood to encompass disclosure of a "coupling method and/or technique, and or device." Such changes and alternative terms are to be understood to be explicitly included in the description.

Thus, the applicant(s) should be understood to have support to claim and make a statement of invention to at least: i) each of the methods, improvements and/or devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group*, PLC, 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. A bolt hold-open system comprising:

a block having a vertical slotted aperture positioned on the top surface of said block and removably mounted internally within a firearm receiver below a bolt assembly;

a lifter assembly removably positioned within said vertical slotted aperture having:

a top plate positioned beneath a bolt;

a tubular shaft having a top end, a bottom end, and defining an internal spring housing that is open at the bottom end and closed at the top end by the top plate;

a cross pin slot intersecting the spring housing;

a spring internally positioned within said spring housing;

wherein said lifter assembly is secured within said vertical slotted aperture by a cross pin inserted through a pin aperture on said block and said cross pin slot;

wherein a spring-loaded magazine follower engages and exerts an upward force on said lifter assembly; and wherein the firing of the last round of a magazine generates an ejection force causing said bolt assembly to move rearward past said lifter assembly allowing said lifter assembly to extend upward and block a forward return motion of said bolt assembly.

2. The system of claim 1, wherein said firearm receiver comprises a firearm receiver from an AK-47, or an AK-47 variant.

3. The system of claim 2, wherein said block comprises a block having a plurality of match rivet attachment points.

4. The system of claim 1, wherein said lifter assembly further comprises:

a bearing positioned within said spring housing and responsive to said cross pin; and a coupler removably secured to the bottom end of the shaft enclosing the spring.

5. The system of claim 1, wherein said top plate comprises a break tab and a bolt stop.

6. The system of claim 5, wherein the magazine follower comprises a magazine follower having a flat spring extending upwards from the lower portion of the rear surface of a magazine, wherein said flat spring engages and exerts an upward force on said break tab.

7. The system of claim 5, wherein said bolt stop of said lifter assembly engages the bolt assembly such that a return spring force of said bolt assembly holds said bolt against said bolt stop.

8. The system of claim 7, wherein said bolt assembly further comprises a charging handle that releases the engagement between said bolt stop and said bolt.

9. The system of claim 1, and further comprising a lifter release and engagement assembly that manually retracts or extends the lifter assembly.

10. The system of claim 9, wherein said lifter release and release engagement assembly comprises a pull rod coupled with a handle assembly.

11. A bolt hold-open assembly comprising:

a firearm having a bolt assembly comprising a bolt and a bolt carrier;

a block having a vertical slotted aperture positioned on the top surface of said block and mounted internally within a firearm receiver;

a lifter assembly removably positioned within the vertical slotted aperture of said block having:

a shaft forming an internal spring housing and a cross pin slot;

a spring positioned with said spring housing;

at least one bearing positioned adjacent to said spring;

a top plate having a break tab and a bolt stop;

a cross pin inserted through a pin aperture on said block and positioned within said cross pin slot adjacent to said bearing forming a tractable coupling;

a coupler removably secured to a bottom end of the shaft and enclosing the spring and configured to allow insertion and removal of said spring from said spring housing;

wherein a magazine follower that engages the break tab of said top plate after the last cartridge of a magazine has been chambered exerting an upward force on said top plate against the bottom of said bolt; and wherein firing of said last cartridge moves said bolt assembly rearward past said top plate allowing said top plate to extend upward blocking a forward return motion of said bolt assembly.

12. The device of claim 11, wherein said firearm comprises an AK-47, or an AK-47 variant.

13. The device of claim 12, wherein said block comprises a block having a plurality of match rivet attachment points.

14. The device of claim 11, wherein the magazine follower comprises a magazine follower having a flat spring extending upwards from the lower portion of the rear surface of a magazine, wherein said flat spring engages and exerts an upward force on said break tab.

15. The device of claim 11, wherein said bolt stop of said lifter assembly engages the bolt assembly such that a return spring force of said bolt assembly holds said bolt against said bolt stop.

16. The device of claim 11, wherein said bolt assembly further comprises a charging handle that releases engagement between said bolt stop and said bolt.

17. The device of claim 11, and further comprising a lifter release and engagement assembly.

18. The device of claim 17, wherein the lifter release and engagement assembly comprises a pull rod coupled with a handle assembly that manually retracts or extends the lifter assembly.

* * * * *